US005965985A

United States Patent [19]

Nerone

[11] Patent Number: 5,965,985

[45] Date of Patent: Oct. 12, 1999

[54] DIMMABLE BALLAST WITH COMPLEMENTARY CONVERTER SWITCHES

[75] Inventor: Louis R. Nerone, Brecksville, Ohio

[73] Assignee: General Electric Company, Schnectady, N.Y.

[21] Appl. No.: 09/052,504

[22] Filed: Mar. 31, 1998

Related U.S. Application Data

[63] Continuation-in-part of application No. 08/709,062, Sep. 6, 1996, Pat. No. 5,796,214, and a continuation-in-part of application No. 08/897,345, Jul. 21, 1997, which is a continuation-in-part of application No. 08/794,071, Feb. 4, 1997, abandoned.

[51] Int. Cl.[6] ..... H05B 37/02

[52] U.S. Cl. ..... 315/DIG. 4; 315/209 R; 315/244

[58] Field of Search ..... 315/244, 225, 315/209 R, 219, 224, DIG. 4

[56] References Cited

U.S. PATENT DOCUMENTS

| | | | |
|---|---|---|---|
| 4,370,600 | 1/1983 | Zansky | 315/244 |
| 4,463,286 | 7/1984 | Justice | 315/219 |
| 4,546,290 | 10/1985 | Kerekes | 315/209 R |
| 4,588,925 | 5/1986 | Fahnrich et al. | 315/101 |
| 4,614,897 | 9/1986 | Kumbatovic | 315/224 |
| 4,647,817 | 3/1987 | Fahnrich et al. | 315/104 |
| 4,667,345 | 5/1987 | Nilssen | 315/209 R |
| 4,692,667 | 9/1987 | Nilssen | 315/209 R |
| 4,937,470 | 6/1990 | Zeller | 307/270 |
| 4,945,278 | 7/1990 | Chern | 315/209 R |
| 5,223,767 | 6/1993 | Kulka | 315/209 R |
| 5,309,062 | 5/1994 | Perkins et al. | 315/53 |
| 5,341,068 | 8/1994 | Nerone | 315/219 |
| 5,349,270 | 9/1994 | Roll et al. | 315/209 R |
| 5,355,055 | 10/1994 | Tary | 315/209 R |
| 5,387,847 | 2/1995 | Wood | 315/209 R |
| 5,406,177 | 4/1995 | Nerone | 315/307 |
| 5,514,981 | 5/1996 | Tam et al. | 326/80 |

*Primary Examiner*—David H. Yu

[57] ABSTRACT

A dimmable ballast circuit for a gas discharge lamp comprises a resonant load circuit with a resonant inductance, a resonant capacitance and circuitry for connecting to a gas discharge lamp. A d.c.-to-a.c. converter circuit is coupled to the resonant load circuit for inducing a.c. current therein, and comprises a pair of switches serially connected between a bus conductor at a d.c. voltage and a reference conductor. The voltage between a reference node and a control node of each switch determines the conduction state of the associated switch. The respective reference nodes of the switches are interconnected at a common node through which the a.c. current flows, and the respective control nodes of the switches are substantially directly interconnected. A gate drive arrangement for regeneratively controlling the switches comprises a driving inductor connected between the common node and the control nodes and mutually coupled to the resonant inductor for sensing current therein. A second inductor is serially connected to the driving inductor, and together with the driving inductor is connected between the common node and the control nodes. A clamping circuit limits the voltage across the second inductor to achieve desired lamp output, and includes a control winding mutually coupled to the second inductor. A control circuit controls voltage across the control winding in response to an error signal representing difference between a user-selectable set point signal and a feedback signal representing a time-averaged value of a lamp operating parameter.

13 Claims, 3 Drawing Sheets

DIMMABLE BALLAST WITH COMPLEMENTARY CONVERTER SWITCHES

This is a continuation-in-part of application Ser. No. 08/709,062, filed on Sep. 6, 1996, now U.S. Pat. No. 5,796,214, and a continuation-in-part of application Ser. No. 08/897,345, filed on Jul. 21, 1997, which is a continuation-in-part of application Ser. No. 08/794,071, filed Feb. 4, 1997, now abandoned.

FIELD OF THE INVENTION

The present invention relates to a ballast, or power supply circuit, for gas discharge lamps of the type using regenerative gate drive circuitry to control a pair of serially connected, complementary conduction type switches of a d.c.- to -ac. converter. More particularly, the invention relates to such a ballast allowing a user to adjust the intensity of lamp output during lamp operation.

BACKGROUND OF THE INVENTION

The above-mentioned application Ser. No. 08/709,062, filed on Sep. 6, 1996 by the present inventor, discloses a ballast circuit using regenerative gate drive circuitry to control a pair of serially connected, complementary conduction type switches of an d.c.-to-a.c. converter. Such switches may comprise an n-channel enhancement mode MOSFET and a p-channel enhancement mode MOSFET, for example. In the disclosed ballast, the phase angle between a resonant load current and a control voltage for the switches moves towards 0° during lamp ignition, providing reliable lamp ignitiion.

It would be desirable to adapt the foregoing ballast to allow a user to adjust the intensity of lamp output while the lamp is operating. For lamps having resistively heated cathodes, it would also be desirable to provide, upon initial power delivery to the ballast, a cathode preheat period during which the cathodes are heated to a desired temperature before igniting the lamp.

SUMMARY OF THE INVENTION

In accordance with an exemplary embodiment of the invention, the present invention provides a dimmable ballast circuit for a gas discharge lamp, comprising a resonant load circuit with a resonant inductance, a resonant capacitance and circuitry for connecting to a gas discharge lamp. A d.c.-to-a.c. converter circuit is coupled to the resonant load circuit for inducing a.c. current therein, and comprises a pair of switches serially connected between a bus conductor at a d.c. voltage and a reference conductor. The voltage between a reference node and a control node of each switch determines the conduction state of the associated switch. The respective reference nodes of the switches are interconnected at a common node through which the a.c. current flows, and the respective control nodes of the switches are substantially directly interconnected. A gate drive arrangement for regeneratively controlling the switches comprises a driving inductor connected between the common node and the control nodes and mutually coupled to the resonant inductor for sensing current therein. A second inductor is serially connected to the driving inductor, and together with the driving inductor is connected between the common node and the control nodes. A clamping circuit limits the voltage across the second inductor to achieve desired lamp output, and includes a control winding mutually coupled to the second inductor. A control circuit controls voltage across the control winding in response to an error signal representing difference between a user-selectable set point signal and a feedback signal representing a time-averaged value of a lamp operating parameter.

The foregoing ballast allows a user to adjust the output of the lamp while it operates. Moreover, when the lamp includes resistively heated cathodes, the clamping circuit can include a circuit for setting the voltage across the control winding to a value allowing the cathodes to reach a desired temperature before the lamp ignites.

DETAILED DESCRIPTION OF THE INVENTION

Figure 1:
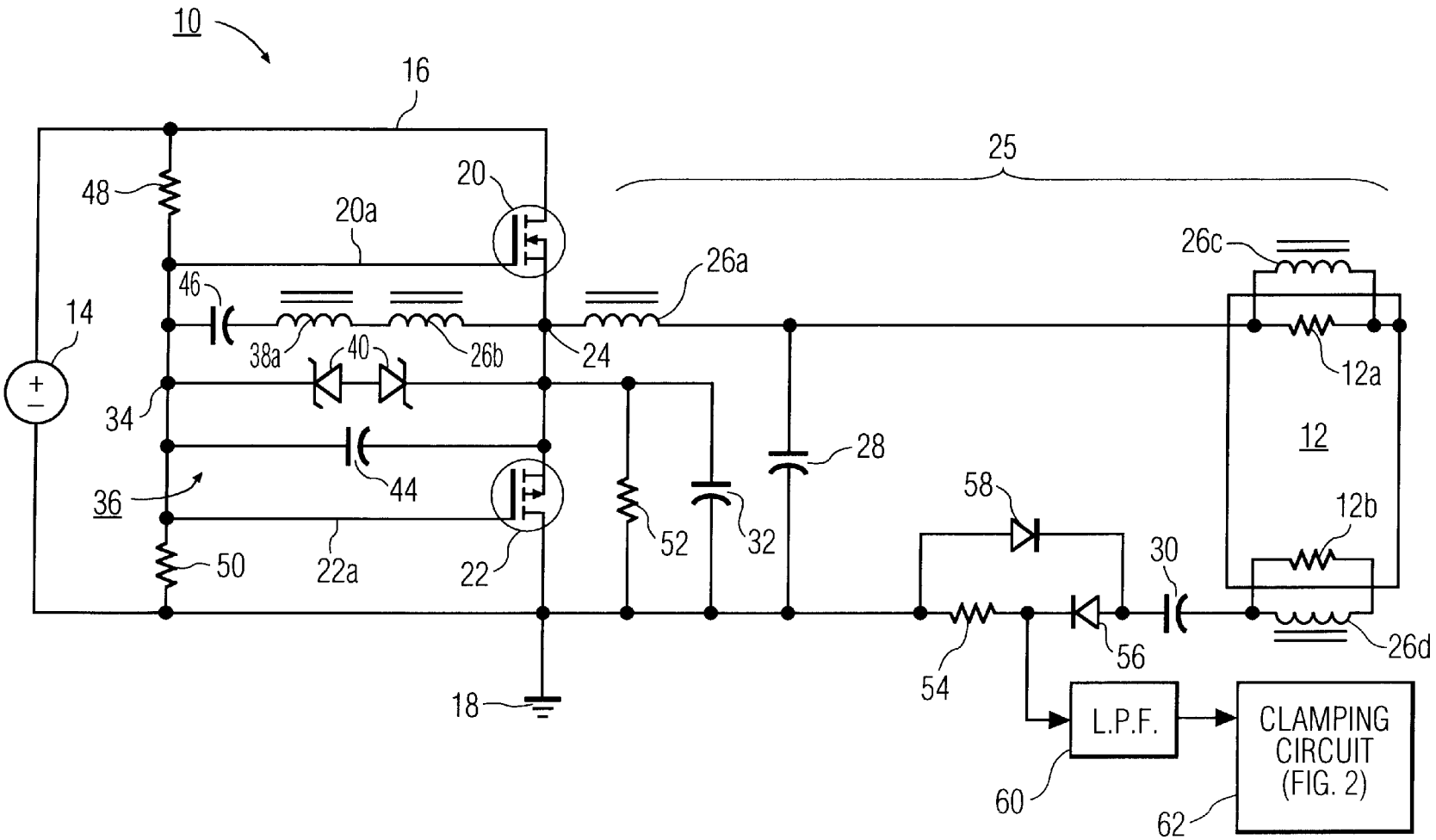
FIG. 1 is a schematic diagram, partially in block form, of a ballast circuit in accordance with the invention.

FIG. 1 shows a ballast circuit 10 in accordance with the present invention. A gas discharge lamp 12 is powered from a d.c. bus voltage existing between a bus conductor 16 and a reference conductor 18, after such voltage is converted to a.c. Switches 20 and 22, serially connected between conductors 16 and 18, are used in this conversion process. When the switches comprise n-channel and p-channel enhancement mode MOSFETs, respectively, the source electrodes of the switches are connected substantially directly together at a common node 24. The switches may comprise other devices having complementary conduction modes, such as PNP and NPN Bipolar Junction Transistors. A resonant load circuit 25 includes a resonant inductor 26*a* and a resonant capacitor 28 for setting the frequency of resonant operation. Typically, circuit 25 includes a d.c. blocking capacitor 30 and a so-called snubber capacitor 32. Lamp 12 preferably includes resistively heated cathodes 12*a* and 12*b*, which may be respectively supplied with heating current by windings 26*c* and 26*d* mutually coupled to inductor 26*a*.

Switches 20 and 22 cooperate to provide a.c. current from common node 24 to resonant inductor 26*a*. The gate, or control, electrodes 20*a* and 22*a* of the switches are substantially directly interconnected at a control node or conductor 34. Gate drive circuitry, generally designated 36, is connected between control node 34 and common node 24, for implementing regenerative control of switches 20 and 22. Thus, a gate drive inductor 26*b* is mutually coupled to resonant inductor 26*a*, to induce in inductor 24*a* a voltage proportional to the instantaneous rate of change of current in load circuit 25. A second inductor 38*a* is serially connected to inductor 26*b*, between common node 24 and control node 34. In some applications, it may be desirable to use a further inductor (not shown) connected between the left-shown node of inductor 38*a* and common node 24. A bidirectional voltage clamp 40 connected between nodes 24 and 34, such as the back-to-back Zener diodes shown, cooperates with second inductor 38*a* in such manner that the phase angle between the fundamental frequency component of voltage across resonant load circuit 25 (e.g., from node 24 to node 18) and the a.c. current in resonant inductor 26*a* approaches zero during lamp ignition. A capacitor 46 may be connected in the serial circuit of inductors 38*a* and 26*b*, between nodes 24 and 34, for purposes explained below.

A capacitor 44 is preferably provided between nodes 24 and 34 to predicably limit the rate of change of control voltage between such nodes. This beneficially assures, for instance, a dead time interval during switching of switches 20 and 22 wherein both switches are off between the times of either switch being turned on.

Serially connected resistors 48 and 50 cooperate with a resistor 52 for starting regenerative operation of gate drive circuit 36. In the starting process, capacitor 46 is initially charged, upon energizing of source 14, via resistors 48, 50 and 52. At this instant, the voltage across capacitor 46 is zero, and, during the starting process, serial-connected inductors 26*b* and 38*a* act essentially as a short circuit, due to the relatively long time constant for charging of capacitor 46. With resistors 48–52 being of equal value, for instance, the voltage on node 24, upon initial bus energizing, is approximately ⅓ of the bus voltage, while the voltage at node 34, between resistors 48 and 50 is ½ of the bus voltage. In this manner, capacitor 46 becomes increasingly charged, from left to right, until it reaches the threshold voltage of the gate-to-source voltage of upper switch 20 (e.g., 2–3 volts). At this point, the upper switch switches into its conduction mode, which then results in current being supplied by that switch to resonant load circuit 25. In turn, the resulting current in the resonant load circuit causes regenerative control of switches 20 and 22.

During steady state operation of ballast circuit 10, the voltage of common node 24 becomes approximately ½ of the bus voltage. The voltage at node 34 also becomes approximately ½ of the bus voltage, so that capacitor 46 cannot again, during steady state operation, become charged so as to again create a starting pulse for turning on switch 20. During steady state operation, the capacitive reactance of capacitor 46 is much smaller than the inductive reactance of gate driving inductor 26*b* and second inductor 38*a*, so that capacitor 46 does not interfere with operation of those inductors.

Resistor 52 may be alternatively placed in shunt across switch 20 (not shown) rather than across switch 22. The operation of the circuit is similar to that described above with respect to resistor 52 shunting switch 22. However, initially, common node 24 assumes a higher potential than node 34, so that capacitor 46 becomes charged from right to left. The result is an increasingly negative voltage between node 34 and node 24, which is effective for turning on switch 22.

Resistors 48 and 50 are both preferably used in the circuit of FIG. 1; however, the circuit functions substantially as intended with resistor 50 removed and using resistor 52. Starting might be somewhat slower and at a higher line voltage. Alternately, the circuit also functions substantially as intended with resistor 48 removed and connecting resistor 52 so as to shunt switch 20.

Lamp current is sensed by a sensing resistor 54, connected with p-n diode 56 to receive half cycles of lamp current. Half cycles of lamp current of the other polarity are shunted across resistor 54 by a diode 58. After passing through a low pass filter 60, a time-averaged feedback signal is passed to a clamping circuit 62 for clamping the voltage across second inductor 38*a*. If desired, parameters of lamp output other than current could be sensed to provide an alternative feedback signal.

Figure 2:
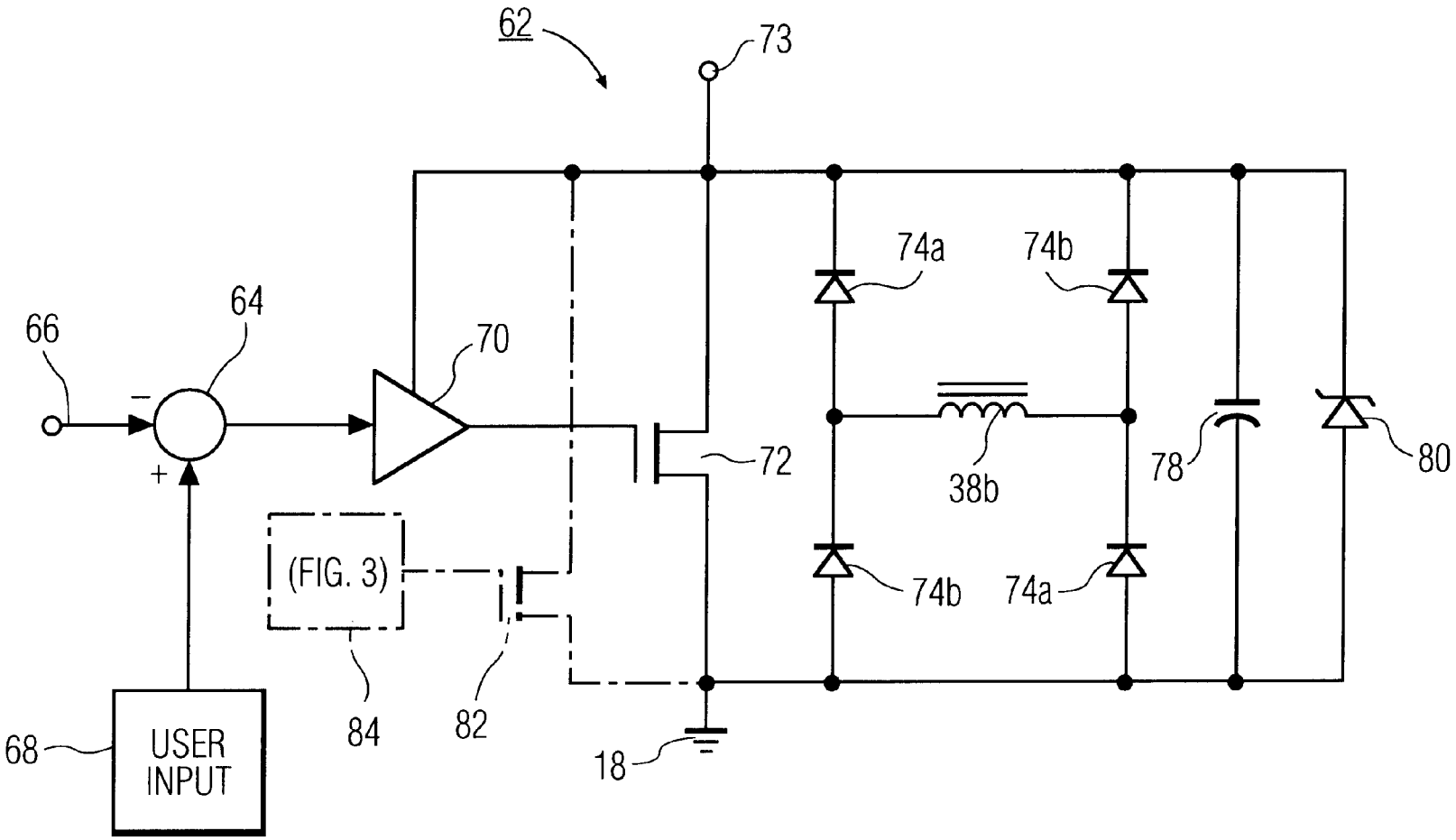
FIG. 2 is a schematic diagram, partially in block form, of a clamping circuit 62 shown in FIG. 1.

Referring to FIG. 2, a summing circuit 64 receives on its negative input node 66 the time-averaged feedback signal from low pass filter 60, and receives on its positive input a set point signal chosen in response to a user input 68. Input 68 can be obtained from a potentiometer (not shown) that can vary the set point signal. The output of summing circuit 64 is a so-called error signal. After amplification by an error amplifier 70, powered from a node 73, the error signal is applied to the gate of a switch 72, such as a p-channel enhancement mode MOSFET. During some stages of operation, the control of switch 72 determines the voltage across a control winding 38*b*, which is mutually coupled to second winding, second inductor 38*a* (FIG. 1). A diode bridge network 74*a*–74*b* enables the single switch 72 to conduct current through winding 38*b* in both directions, e.g., first through diodes 74*a*, 74*b* and then through diodes 75*a*, 75*b*. The use of high speed diodes beneficially allows high frequency operation of the ballast, e.g., at 2.5 megahertz. Without the bridge network, two switches are typically required for conducting current in both directions through the control winding.

Preferably, a capacitor 78 shunts switch 72 to assist in clamping voltage across the control winding. A voltage clamp 80, such as a Zener diode, preferably shunts switch 72, to set a maximum voltage across the lamp during its ignition, or starting. Preferably, the lower node of switch 72 comprises reference conductor 18 (FIG. 1), and upper node 73 comprises a power supply node coupled via a resistor (not shown) to bus conductor 16 (FIG. 1). In conjunction with bridge network 74*a*–75*b*, voltage clamp 80 serves as a bidirectional voltage clamp for the voltage across control winding 38*b*.

With proper selection of error amplifier 70, the function of switch 72 can be handled by a switch (not shown) within the amplifier. In such case, the function of voltage clamp 80 is preferably realized by a voltage clamp (not shown) associated with a power input (not shown) to the amplifier.

Figure 3:
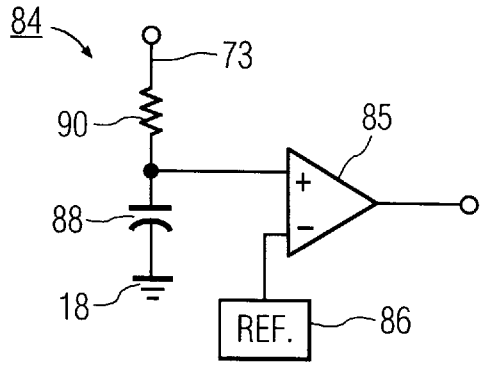
FIG. 3 is a schematic diagram of a control circuit 84 shown in FIG. 2.

A preheat switch 82, such as a p-channel enhancement mode MOSFET, may be provided to conduct for a preheat timing interval when the ballast circuit is first supplied with d.c. bus voltage. When conducting, switch 82 overrides single switch 72 (or a pair of switches if used) by shorting the output of the switch (or switches). This allows resistively heated cathodes 12*a* and 12*b* (FIG. 1) to reach a desired temperature before lamp ignition. Circuit 84 for controlling switch 82 may be constructed as shown in FIG. 3. As shown in FIG. 3, a comparator 85 receives a reference voltage from circuit 86 on its negative input, and upon bus energization, an increasing voltage on its positive input connected to a preheat capacitor 88. The capacitor is charged by current conducted from node 73 by a preheat resistor 90. The values of resistor 90 and capacitor 88 determine the duration of the preheat period during which switch 82 (FIG. 2) conducts upon bus energization.

Figure 4A:
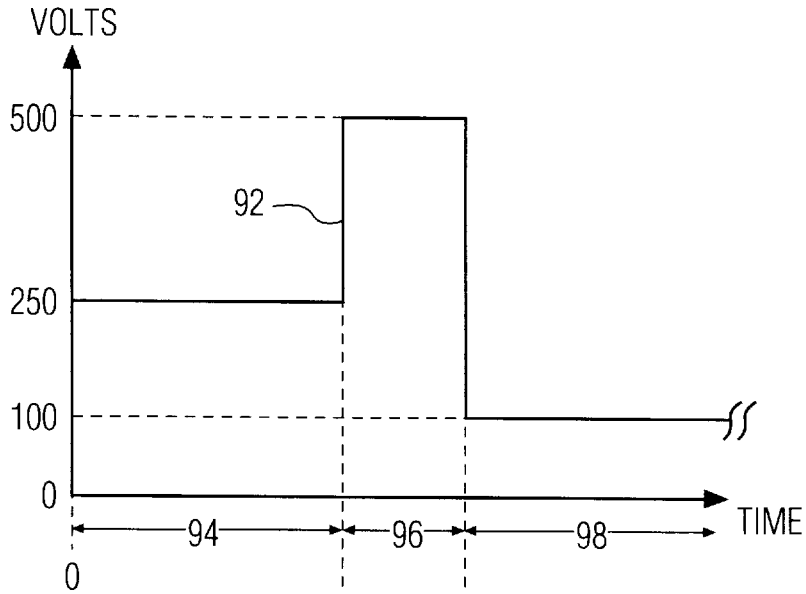
FIG. 4A shows in simplified form lamp voltage for three successive time intervals.

To illustrate preferred operation of the inventive ballast, FIG. 4A shows in simplified form lamp voltage 92 for three successive time intervals 94, 96 and 98. Interval 94 represents a pre-heat period before lamp ignition during which the lamp cathodes are heated. Interval 96 represents a period during which the lamp ignites. Interval 98 represents normal, or steady state, operation of the lamp.

Referring to FIG. 4A, during the pre-heat period, the lamp voltage is preferably set to a value, e.g., 250 volts, allowing the lamp cathodes 12*a* and 12*b* (FIG. 1) to reach a desired temperature before igniting the lamp, but not high enough to cause lamp ignition. This can be accomplished through use of preheat switch 82 (FIG. 2) and control circuit 84 (FIG. 3).

During period 96 (FIG. 4A), lamp voltage 92 reaches a level suitable to allow the lamp to ignite, e.g, 500 volts. Such voltage results from use of voltage clamp 80 (FIG. 2) in conjunction with diode bridge 74*a*–74*b*. Together, such circuitry provides a bidirectional clamp on voltage across control winding 38*b* so as to limit the lamp voltage, which naturally tends to rise from near-resonant operation during lamp ignition.

During period 98, lamp voltage 92 reaches a steady state level. This can be accomplished through control of switch 72 of clamping circuit 62 (FIG. 2) in response to the feedback signal on node 66 and a user-selected set point chosen by user input 68. By changing the set point, a user can vary, for instance, the brightness of the lamp.

Figure 4B:
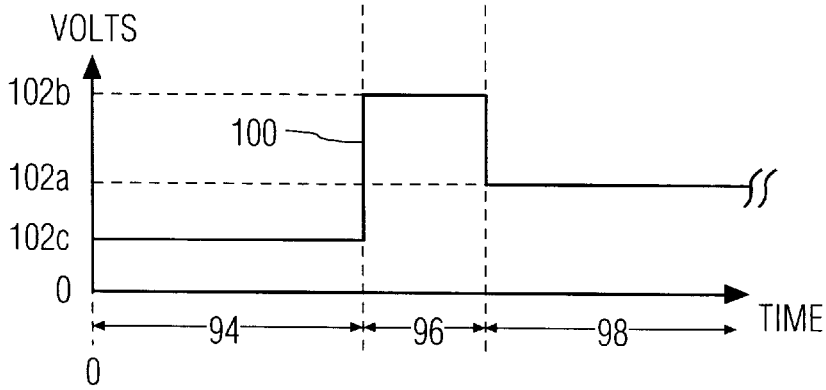
FIG. 4B shows voltage across inductor 38*a* of FIG. 1 for the same time intervals shown in FIG. 4A.

Corresponding to the changes of lamp voltage shown in FIG. 4A, FIG. 4B shows changes in voltage 100 of second inductor 38*a* (FIG. 1) for time periods 94, 96 and 98. During period 94, voltage 100 is at a level 102*c*, allowing the lamp cathodes to heat up. During period 96, voltage 100 reaches level 102*b*, allowing the lamp to ignite. During period 98, voltage 100 is at a steady state level 102*a* that can be varied through user input 68 (FIG. 2). Voltage levels 102*a*–102*c* generally correspond to, but are not necessarily proportional to, the three levels of lamp voltage shown in FIG. 4A.

In more detail, a decrease in voltage across second inductor 38*a* (FIG. 1), for instance, from level 102*b* to level 102*c*, causes the frequency of switching of switches 20 and 22 (FIG. 1) to increase. This, in turn, causes lamp current (and lamp voltage) to decrease. The converse is also true: An increase in voltage across the second inductor decreases frequency of switching of switches 20 and 22, in turn increasing lamp current (and lamp voltage).

The inventive ballast may be used with light-dimming circuits employing a triac.

Exemplary component values for the circuit of FIGS. 1–3 are as follows for a fluorescent lamp 12 rated at 17.5 watts, with a d.c. bus voltage of 160 volts:

Resonant inductor 26*a* . . . 600 micro henries

Driving inductor 26*b* . . . 2.0 micro henries

Cathode-heating windings 26*c* and 26*d*, each . . . 0.5 micro henries

Turns ratio between 26*a* and 26*b* . . . about 17

Turns ratio between 26*a* and each of 26*c* and 26*d* . . . about 34

Cathodes 12*a* and 12*b*, each . . . 6 ohms

Second inductor 38*a* 250 micro henries

Control winding 38*b* (FIG. 2) . . . 250 micro henries

Turns ratio between 38*a* and 38*b* . . . 1

Capacitor 44 . . . 4.7 nanofarads

Capacitor 46 . . . 0.1 microfarads

Zener diodes 40, each . . . 10 volts

Resistors 48, 50 and 52, each . . . 270 k ohms

Resonant capacitor 28 . . . 3.3 nanofarads

D.c. blocking capacitor 30 . . . 0.22 microfarads

Snubber capacitor 32 . . . 470 picofarads

Sensing resistor 54 . . . 10 ohms

Capacitor 78 (FIG. 2) . . . 1.0 microfarads

Zener diode 80 (FIG. 2) . . . 20 volts

Additionally, switch 20 may be an IRFR210, n-channel, enhancement mode MOSFET, sold by International Rectifier Company, of El Segundo, Calif.; and switch 22, an IRFR9210, p-channel, enhancement mode MOSFET also sold by International Rectifier Company. Error amplifier 70 (FIG. 2) may be an LMC7101 amplifier sold by National Semiconductor of Santa Clara, Calif. Finally, control circuit 84 (FIG. 3) may set a preheat duration of about 1 second.

While the invention has been described with respect to specific embodiments by way of illustration, many modifications and changes will occur to those skilled in the art. It is therefore, to be understood that the appended claims are intended to cover all such modifications and changes as fall within the true spirit and scope of the invention.

What is claimed is:

1. A dimmable ballast circuit for a gas discharge lamp, comprising:

(a) a resonant load circuit having a resonant inductance, a resonant capacitance and means for connecting to a gas discharge lamp;

(b) a d.c.-to-a.c. converter circuit coupled to said resonant load circuit for inducing a.c. current therein, said converter circuit comprising:

(i) a pair of switches serially connected between a bus conductor at a d.c. voltage and a reference conductor, the voltage between a reference node and a control node of each switch determining the conduction state of the associated switch;

(ii) the respective reference nodes of said switches being interconnected at a common node through which said a.c. current flows, and the respective control nodes of said switches being substantially directly interconnected electrically;

(c) a gate drive arrangement for regeneratively controlling said switches, comprising:

(i) a driving inductor connected between said common node and said control nodes and mutually coupled to said resonant inductance for sensing current therein; and (ii) a second inductor serially connected to said driving inductor, and together with said driving inductor being connected between said common node and said control nodes; and (d) a clamping circuit for limiting the voltage across said second inductor to achieve desired lamp output; said clamping circuit comprising:

(i) a control winding mutually coupled to said second inductor; and (ii) a control circuit for controlling voltage across said control winding in response to an error signal representing difference between a user-selectable set point signal and a feedback signal representing a time-averaged value of a lamp operating parameter.

2. The ballast circuit of claim 1, wherein said feedback signal represents lamp current.

3. The ballast circuit of claim 1, wherein said gate drive arrangement further comprises:

(a) a bidirectional voltage clamp connected between said common node and said control nodes for limiting positive and negative excursions of voltage of said control nodes with respect to said common node;

(b) said second inductor cooperating with said voltage clamp in such manner that the phase angle between the fundamental frequency component of voltage across said resonant load circuit and said a.c. current approaches zero during lamp ignition.

4. The ballast circuit of claim 1, wherein said control circuit comprises a single switch controlled in response to said error signal and a diode bridge network for allowing said single switch to conduct current in either direction through said control winding.

5. The ballast circuit of claim 4, wherein said control circuit comprises a capacitor coupled across said control winding for cooperatively assisting in clamping voltage of said second inductor.

6. The ballast circuit of claim 1, wherein said clamping circuit includes a bidirectional voltage clamp for limiting voltage across said control winding during lamp ignition.

7. The ballast circuit of claim 1, wherein:

(a) said lamp includes resistively heated cathodes; and (b) said clamping circuit includes a circuit for setting the voltage across said control winding to a value that allows said cathodes to reach a desired temperature before the lamp ignites.

8. A dimmable ballast circuit for a gas discharge lamp, comprising:

(a) a resonant load circuit having a resonant inductance, a resonant capacitance and means for connecting to a gas discharge lamp;

(b) a d.c.-to-a.c. converter circuit coupled to said resonant load circuit for inducing a.c. current therein, said converter circuit comprising:

(i) a pair of switches serially connected between a bus conductor at a d.c. voltage and a reference conductor, the voltage between a reference node and a control node of each switch determining the conduction state of the associated switch;

(ii) the respective reference nodes of said switches being interconnected at a common node through which said a.c. current flows, and the respective control nodes of said switches being substantially directly interconnected electrically;

(c) a gate drive arrangement for regeneratively controlling said switches, comprising:

(i) a driving inductor connected between said common node and said control nodes and mutually coupled to said resonant inductance for sensing current therein; and (ii) a second inductor serially connected to said driving inductor, and together with said driving inductor being connected between said common node and said control nodes; and (d) a clamping circuit for limiting the voltage across said second inductor to achieve desired lamp output; said clamping circuit comprising:

(i) a control winding mutually coupled to said second inductor; and (ii) a control circuit for controlling voltage across said control winding in response to an error signal representing difference between a user-selectable set point signal and a feedback signal representing a time-averaged value of a lamp operating parameter; said control circuit comprising a control switch coupled to said control winding and controlled in response to said error signal.

9. The ballast circuit of claim 8, wherein said feedback signal represents lamp current.

10. The ballast circuit of claim 8, wherein said gate drive arrangement further comprises:

(a) a bidirectional voltage clamp connected between said common node and said control nodes for limiting positive and negative excursions of voltage of said control nodes with respect to said common node;

(b) said second inductor cooperating with said voltage clamp in such manner that the phase angle between the fundamental frequency component of voltage across said resonant load circuit and said a.c. current approaches zero during lamp ignition.

11. The ballast circuit of claim 8, wherein said control circuit comprises a capacitor coupled across said control winding for cooperatively assisting in clamping voltage of said second inductor.

12. The ballast circuit of claim 8, wherein said clamping circuit includes a bidirectional voltage clamp for limiting voltage across said control winding during lamp ignition.

13. The ballast circuit of claim 8, wherein:

(a) said lamp includes resistively heated cathodes; and (b) said clamping circuit includes an override circuit for setting the voltage across said control winding to a value that allows said cathodes to reach a desired temperature before the lamp ignites; said override circuit comprising a switch for temporarily shorting the output of said control switch.

* * * * *